US008594523B2

(12) United States Patent
Tajiri et al.

(10) Patent No.: US 8,594,523 B2
(45) Date of Patent: Nov. 26, 2013

(54) IMAGE FORMING APPARATUS WITH A TEMPERATURE SENSOR DISPOSED APART FROM A HEATING MEMBER

(75) Inventors: Fumitake Tajiri, Nagoya (JP); Terumasa Ito, Aisai (JP); Masaki Yasuda, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 541 days.

(21) Appl. No.: 12/614,463

(22) Filed: Nov. 9, 2009

(65) Prior Publication Data

US 2010/0129106 A1 May 27, 2010

(30) Foreign Application Priority Data

Nov. 26, 2008 (JP) ..... 2008-300601

(51) Int. Cl.
*G03G 15/20* (2006.01)

(52) U.S. Cl.
USPC ..... 399/69; 399/33

(58) Field of Classification Search
USPC ..... 399/33, 67–70
See application file for complete search history.

(56) References Cited

U.S. PATENT DOCUMENTS

| | | | | |
|---|---|---|---|---|
| 7,454,151 | B2 | 11/2008 | Satoh et al. | |
| 7,970,299 | B2 | 6/2011 | Sato | |
| 2004/0086295 | A1 * | 5/2004 | Peng et al. | 399/69 |
| 2006/0165429 | A1 | 7/2006 | Satoh et al. | |
| 2007/0140719 | A1 | 6/2007 | Sato | |
| 2008/0069581 | A1 | 3/2008 | Otsuka | |

FOREIGN PATENT DOCUMENTS

| | | | |
|---|---|---|---|
| JP | 6-130856 | A | 5/1994 |
| JP | 2003-057990 | A | 2/2003 |
| JP | 2003-065853 | | 3/2003 |
| JP | 2006-154487 | A | 6/2006 |
| JP | 2007-108686 | A | 4/2007 |
| JP | 2007-271785 | A | 10/2007 |
| JP | 2008-076635 | A | 4/2008 |

OTHER PUBLICATIONS

JP Office Action dtd Sep. 6, 2011, JP Appln. 2008-300601, English translation.
Notification of Reasons for Refusal mailed Oct. 19, 2010 in Japanese Application No. 2008-300601 and English translation thereof.
JP Notification of Reasons for Refusal dated Nov. 8, 2011; corresponding JP Application No. 2011-137029; English Translation.

* cited by examiner

*Primary Examiner* — Joseph S Wong
(74) *Attorney, Agent, or Firm* — Banner & Witcoff, Ltd.

(57) ABSTRACT

In an image forming apparatus, a temperature of a heating member heated by a heat source to fix a developer image on a recording sheet is detected by a temperature sensor disposed apart from the heating member. A controller controls the heat source based upon a temperature determined mathematically by application of a specific function to the temperature detected by the temperature sensor. In the controller, the specific function is switched among a plurality of functions according to a control mode which is switchable among a plurality of modes and in which operation of the heat source is regulated.

5 Claims, 6 Drawing Sheets

IMAGE FORMING APPARATUS WITH A TEMPERATURE SENSOR DISPOSED APART FROM A HEATING MEMBER

CROSS-REFERENCE TO RELATED APPLICATION(S)

This application claims priority from Japanese Patent Application No. 2008-300601, which was filed on Nov. 26, 2008, the disclosure of which is incorporated herein by reference in its entirety.

BACKGROUND OF THE INVENTION

1. Field of the Invention

The present invention relates to an image forming apparatus comprising a heating member for use in fixing a developer image on a recording sheet and a temperature sensor for use in detecting a temperature of the heating member.

2. Description of Related Art

An image forming apparatus as disclosed in JP 2003-65853 A is hitherto known in the art. This apparatus comprises a heating roller (heating member) which is heated by a heat source, a noncontact thermistor (temperature sensor) which is disposed apart from the heating roller to detect a temperature of the heating roller, and a controller configured to control the heat source based upon the temperature detected by the noncontact thermistor.

Since the noncontact thermistor is susceptible to environmental conditions of various kinds in the image forming apparatus, data acquired through detection (measurement) by the noncontact thermistor should be appropriately corrected.

Thus, there is a need to provide an image forming apparatus in which a high-precision temperature control can be executed.

The present invention has been made in an attempt to address the aforementioned problem in prior art.

SUMMARY OF THE INVENTION

The inventors of the present invention have noted that a significant aspect of the above problem lies in the following phenomenon. Where the control mode for a heat source is switchable according to the manner in which operation of the heat source is to be regulated, the data acquired through detection by the noncontact thermistor may, in particular, be subject to deviation from the actual temperature of the heating roller because the acquired data varies depending upon the currently adopted control mode.

With this in view, it is one aspect of the present invention to provide an image forming apparatus in which data acquired through detection by a temperature sensor can be appropriately corrected so that a high-precision temperature control can be executed, even if the control mode is switched.

More specifically, an image forming apparatus according to one embodiment of the present invention comprises: a heat source; a heating member heated by the heat source to fix a developer image on a recording sheet; a temperature sensor disposed apart from the heating member to detect a temperature of the heating member; and a controller configured to control the heat source based upon a temperature determined mathematically by application of a specific function to the temperature detected by the temperature sensor, wherein the controller switches the specific function among a plurality of functions according to a control mode in which operation of the heat source is regulated, the control mode being switchable among a plurality of modes.

Herein, each of "a plurality of modes" provides a unique manner of operation in which the heat source is to be regulated, e.g., a specific quantity of heat produced by the heat source per unit time; i.e., the quantity of heat per unit time which is produced in one mode is different from that which is produced in another mode. The "function" comprises any functions encompassing linear, quadratic or higher-order polynomial functions, or exponential functions, or other functions as represented by equations or graphs, as well as those specified by tables of values (e.g., conversion tables) in which the detected temperatures are associated with the actual temperatures such that one actual temperature is assigned to each of the detected temperatures.

According to the above-described configuration embodied as consistent with the present invention, the specific function to be applied in calculation of the temperature can be switched according to an appropriate control mode in which operation of the heat source is currently being regulated. Therefore, even if the quantity of heat produced by the heat source per unit time and transmitted from the heat source to the temperature sensor varies depending upon the control mode, the temperature detected by the temperature sensor can be corrected appropriately. As a result, a high-precision temperature control can be executed.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

A detailed description will be given of exemplary embodiments of the present invention with reference to the drawings.

<General Setup of Laser Printer>

At the outset, a general setup of a laser printer as an example of an image forming apparatus according to an exemplary embodiment of the present invention will be described with reference to FIG. 1.

Figure 1:
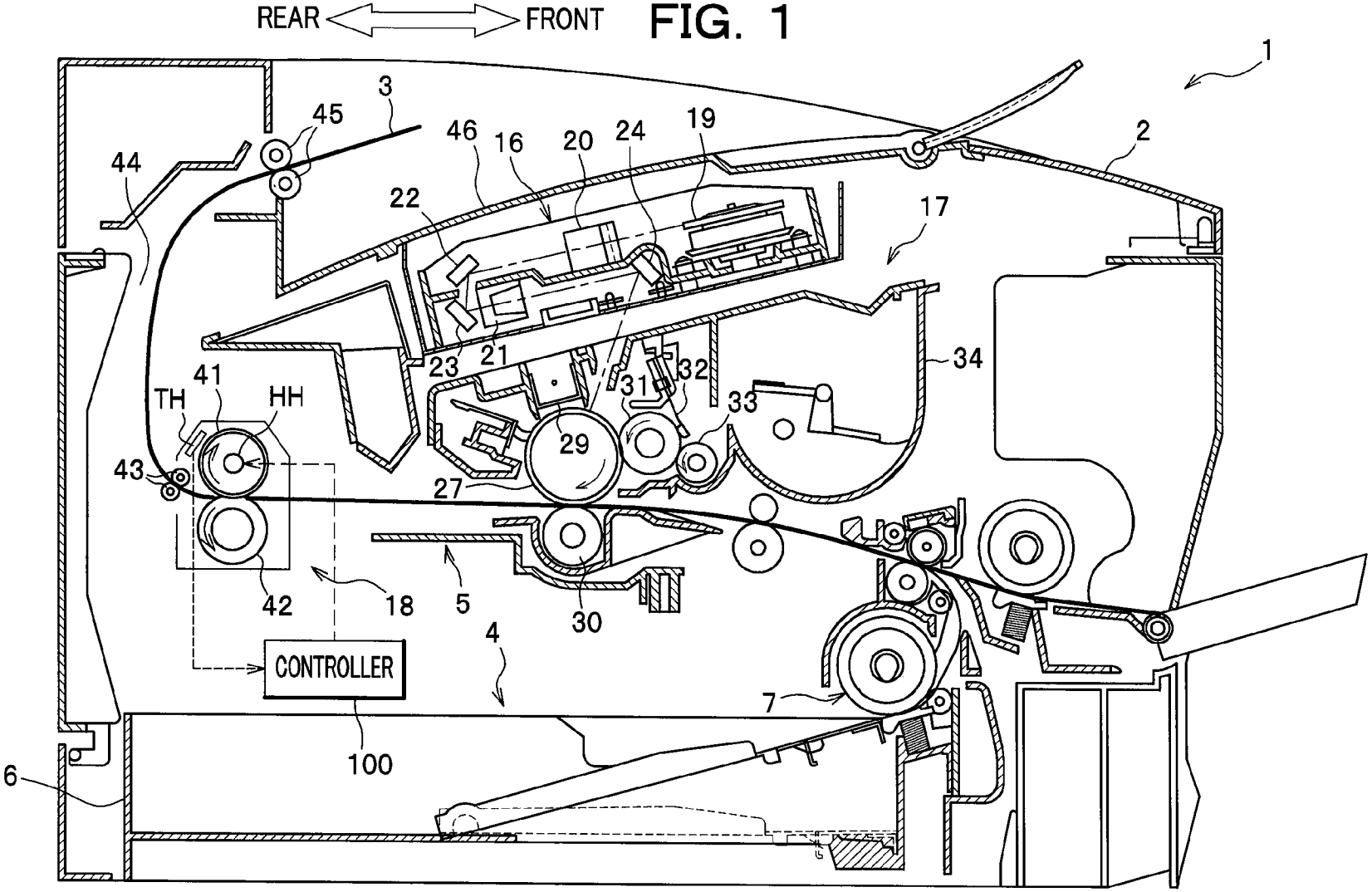
FIG. 1 is a vertical section of a laser printer as an example of an image forming apparatus according to an exemplary embodiment of the present invention.

As shown in FIG. 1, a laser printer 1 comprises a body casing 2, and other components housed within the body casing 2 which principally include a sheet feeder unit 4 for feeding a sheet 3 (e.g., of paper) as one example of a recording sheet, and an image forming unit 5 for forming an image on the sheet 3 fed by the sheet feeder unit 4.

The sheet feeder unit 4 principally includes a sheet feed tray 6 removably installed at a bottom within the body casing 2, and a sheet feed mechanism 7 for feeding a sheet 3 from the sheet feed tray 6 to the image forming unit 5. In the sheet feeder unit 4, sheets 3 in the sheet feed tray 6 are separated and fed one after another by the sheet feed mechanism 7 into the image forming unit 5.

The image forming unit 5 principally includes a scanner unit 16, a process cartridge 17 and a fixing device 18.

The scanner unit 16 is provided in an upper space within the body casing 2, and includes a laser beam emitter (not shown), a polygon mirror 19 configured to be driven to spin, lenses 20, 21, reflecting mirrors 22, 23, 24 and other components. The scanner unit 16 is configured to cause a laser beam to travel along a path indicated by alternate long and short dashed lines so that a peripheral surface of a photoconductor drum 27 in the process cartridge 17 is rapidly scanned and illuminated consecutively with the laser beam.

The process cartridge 17 which is installed under the scanner unit 16 is configured to be detachable from and attachable to the body casing 2. The process cartridge 17 includes a photoconductor drum 27 configured as known in the art, a charger 29, a transfer roller 30, a development roller 31, a doctor blade 32, a supply roller 33, a tonner hopper 34 and other components.

In the process cartridge 15, the peripheral surface of the photoconductor drum 27 is charged by the charger 29, and then exposed to a laser beam directed from the scanner unit 16, whereby an electrostatic latent image is formed on the photoconductor drum 27. Toner in the toner hopper 34 is supplied by the supply roller 33 and the development roller 31 to the photoconductor drum 27, and a toner image (developer image) is formed on the photoconductor drum 27. Thereafter, as a sheet 3 is held and fed forward between the photoconductor drum 27 and the transfer roller 30, the toner image carried on the photoconductor drum 27 is attracted and transferred to the sheet 3.

<Fixing Device>

The fixing device 18 includes a halogen heater HH as one example of a heat source, a heating roller 41 as one example of a heating member, a pressure roller 42, and a thermistor TH as one example of a temperature sensor disposed to detect a temperature of the heating roller 41.

The heating roller 41 is a substantially cylindrical member having a hollow in which the halogen heater HH is installed so that the heating roller 41 is heated from inside by the halogen heater HH. The halogen heater HH is regulated appropriately under control of the controller 100 which will be described later.

The heating roller 41 is a metal member shaped in a substantially cylindrical form, and rotatably supported by the body casing 2. The heating roller 41 is configured to rotate by a driving force received from a driving device (not shown) which is actuated under control signals from the controller 100. The heating roller 41 may, for example, have a cylindrical main body made of aluminum with its peripheral surface coated with Teflon (registered trademark, polytetrafluoroethylene or PTFE).

The pressure roller 42 is pressed by a spring (not shown) against the heating roller 41, and is rotated according as the heating roller 42 in contact therewith rotates. The pressure roller 42 may, for example, have a metal core around which a polyurethane rubber layer is provided, with a tube made of Teflon (registered trade mark, PTFE) being fitted on an outer surface of the polyurethane rubber layer.

The thermistor TH, which is provided to detect the temperature of the heating roller 41, is disposed apart from the heating roller 41 with a predetermined space provided between the heating roller 41 and the thermistor TH. The temperature detected by the thermistor TH is outputted to the controller 100.

In the fixing device 18 configured as described above, the heating roller 41 is heated by the halogen heater HH, and thus the toner image transferred on a sheet 3 is thermally fixed while the sheet 3 passes through between the heating roller 41 and the pressure roller 42. Thereafter, the sheet 3 is conveyed by conveyor rollers 43 to a sheet output path 44. The sheet 3 conveyed to the sheet output path 44 is ejected by sheet output rollers 45 onto a sheet output tray 46.

<Controller>

Next, specific configurations and operations of the controller 100 will be described with reference to FIGS. 2-6.

The controller 100 includes known hardware components such as a central processing unit or CPU, a read-only memory or ROM, a random access memory or RAM, and a communication interface, and is configured to mainly control the halogen heater HH based upon a temperature determined mathematically (hereinafter referred to as "calculated temperature") by application of a specific function to a temperature detected by the thermistor TH (hereinafter referred to as "detected temperature"). The controller 100 is configured to switch the specific function according to a control mode which is switchable or selectable among a plurality of modes so that operation of the halogen heater HH is regulated in one selected control mode.

To be more specific, the controller 100 is configured to apply a function with a greater slope to the specific function for use in determination of the calculated temperature, as the mode adopted requires a larger quantity of heat emitted per unit time from the halogen heater HH to the thermistor TH. Hereinafter, the quantity of heat per unit time will be referred to as "instantaneous heat quantity" where appropriate. Here, the "slope" represents the differential coefficient on the same conditions of variables, provided that the function is a quadratic or higher-order continuous function.

That is, if the functions are, for example, quadratic functions such as:

$$y=x^2, y=2x^2,$$

then the differential coefficients on the same conditions of variables (i.e., x=a) are:

$$dy/dx=2a, dy/dx=4a.$$

Thus, the latter function "$y=2x^2$" is the function with the greater slope.

In the present embodiment, the "plurality of modes" comprise a WARM-UP mode, two FIXING modes and a READY mode. The WARM-UP mode refers to the mode in which the temperature of the heating roller 41 is increased continuously. The FIXING modes refer to the modes in which the temperature of the heating roller 41 is maintained at a fixing temperature Tf (see FIG. 4) suitable to fix a toner image on a sheet 3. The READY mode refers to the mode in which the temperature of the heating roller 41 is maintained at a ready temperature Tr (see FIG. 5) lower than the fixing temperature Tf.

Figure 4:
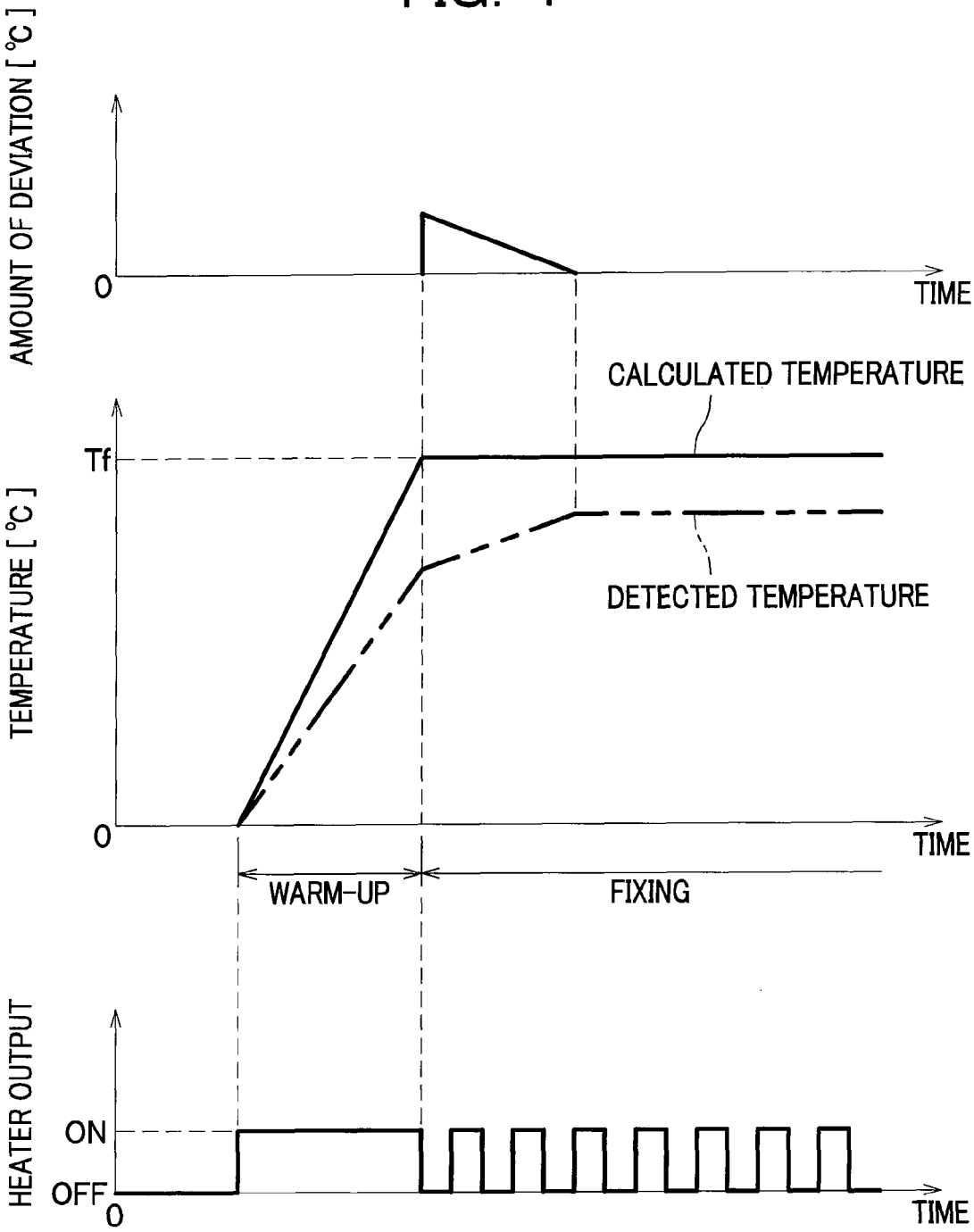
FIG. 4 is a time chart showing correlated changes in a heater output, detected and calculated temperatures, and an amount of deviation of the temperatures, as exhibited when the control mode is switched from a WARM-UP mode to a FIXING mode.

More specifically, in operation, the controller 100 in the WARM-UP mode keeps the halogen heater HH in the ON state to heat the heating roller 41 swiftly (see FIG. 4). Accordingly, the instantaneous heat quantity in the WARM-UP mode is larger than those in all the other modes of the present embodiment.

In the WARM-UP mode, actually, the heating roller 41 is not rotated in its earliest (initial) stage of operation and its rotation is started after the initial stage. Therefore, strictly speaking, the instantaneous heat quantity varies slightly depending upon the state of the heating roller 41 as to whether or not it is being rotated. Macroscopically, however, the instantaneous heat quantity in the WARM-UP mode is substantially the same; thus, in describing the present embodiment, the instantaneous heat quantities in the WARM-UP mode are treated as invariable at each point of time throughout the operation, for the convenience of explanation. In any of the FIXING and READY modes, the heating roller 41 is rotated all the time throughout the operation, and thus the instantaneous heat quantities are not affected by the state of the heating roller 41 as to whether or not it is being rotated.

Figure 2:
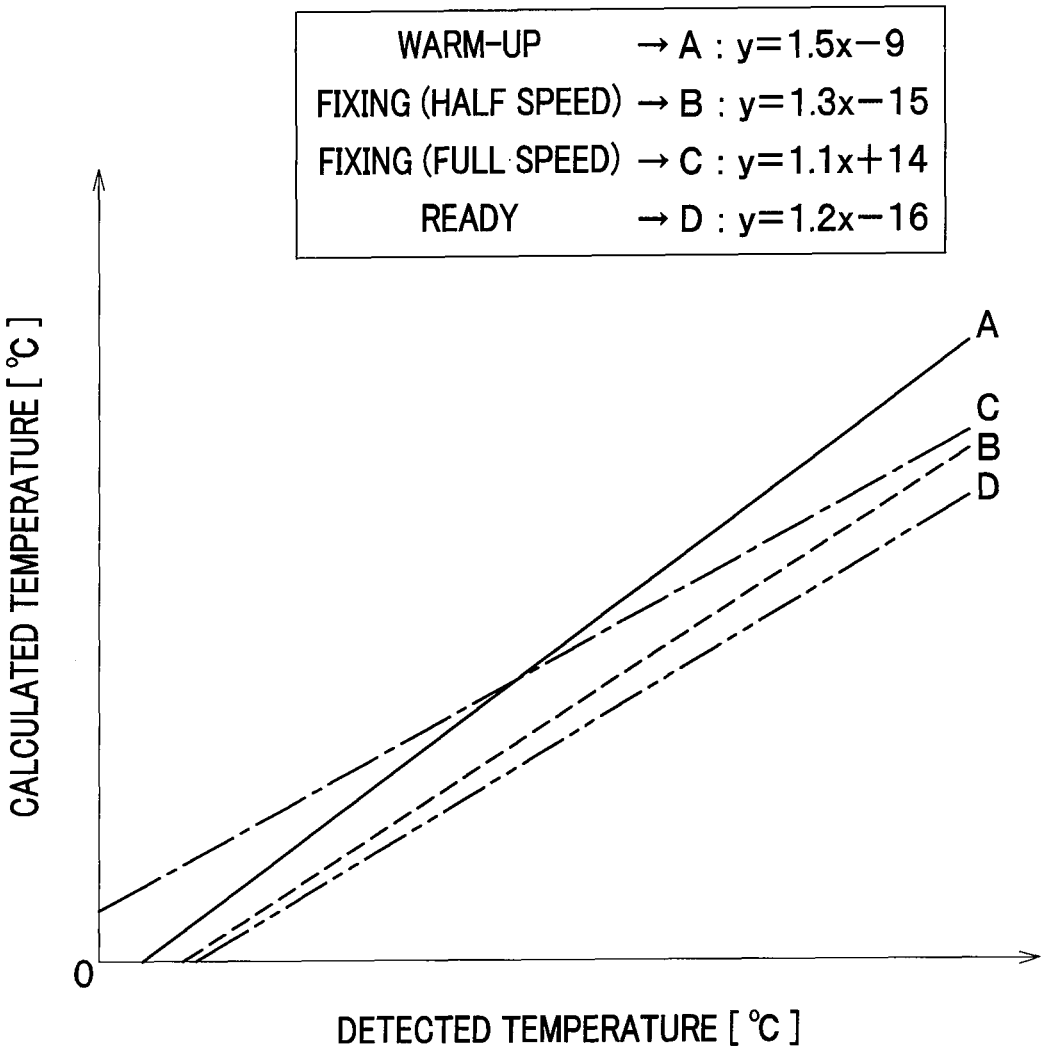
FIG. 2 is a map representing functions applied in calculation of temperatures.

Since the instantaneous heat quantity reaches the maximum in the WARM-UP mode as described above, the controller 100 selects a function A "y=1.5x−9" with the slope greater than those of all the plurality of functions A-D shown in FIG. 2. Accordingly, even if the temperature around the thermistor TH does not follow the swiftly increasing surface temperature of the heating roller 41, the greater slope of the function A makes it possible to adequately determine the calculated temperature from the detected temperature (detected by the thermistor TH) such that the calculated temperature can closely follow the swift change of the surface temperature of the heating roller 41 (and closely approximate the actual surface temperature).

The functions A-D shown in FIG. 2 may be determined in advance by experiments, simulations, etc. The functions A-D may be stored in a storage device (not shown) in the form of a map or a set of functional equations.

In the FIXING modes, the controller 100 causes the halogen heater HH to be activated (switched ON) intermittently so as to maintain the heating roller 41 at a predetermined fixing temperature Tf (see FIG. 4). Thus, in the FIXING modes, the instantaneous heat quantity is smaller than that of the heat to be produced in the WARM-UP mode.

Therefore, in the FIXING modes, the controller 100 selects the function B "y=1.3x−15" or the function C "y=1.1x+14", each having a slope smaller than that of the function A, as shown in FIG. 2. Accordingly, the temperature around the thermistor TH will be able to follow the surface temperature of the heating roller 41 in the FIXING modes with a probability higher than that in the WARM-UP mode, and thus the function B or C with a slope smaller than that of the function A makes it possible to adequately determine the calculated temperature from the detected temperature (detected by the thermistor TH) such that the calculated temperature can closely follow the change of the surface temperature of the heating roller 41 (and closely approximate the actual surface temperature).

In addition, the controller 100 controls the rotation of the heating roller 41 in such a manner that the speed of rotation of the heating roller 41 is reduced in accordance with the thickness of a sheet 3 of paper on which a toner image is to be fixed in the FIXING modes. In this embodiment, the thickness of the sheet 3 is classified into two types, and the controller 100 is configured to rotate the heating roller 41 at the maximum speed of rotation (hereinafter referred to as "full speed") if the thickness of the sheet 3 is less than a predetermined threshold value, while rotating the heating roller 41 at half of the full speed (hereinafter referred to as "half speed") if the thickness of the sheet 3 is not less than the predetermined threshold value.

In this operation, when the speed of rotation of the heating roller 41 is reduced to the half speed, the quantity of heat transferred from the heating roller 41 to the sheet 3 is increased, and accordingly, the heating roller 41 is heated more by the halogen heater HH. Thus, the instantaneous heat quantity emitted from the heating roller 41 to the thermistor TH is increased. When the controller 100 switches the speed of rotation of the heating roller 41 into the half speed which is slower than the previous speed of rotation, it switches the function into the function B which is of the greater slope. On the other hand, when the controller 100 switches the speed of rotation of the heating roller 41 into the full speed which is faster than the previous speed of rotation, it switches the function into the function C which is of the smaller slope.

Figure 6:
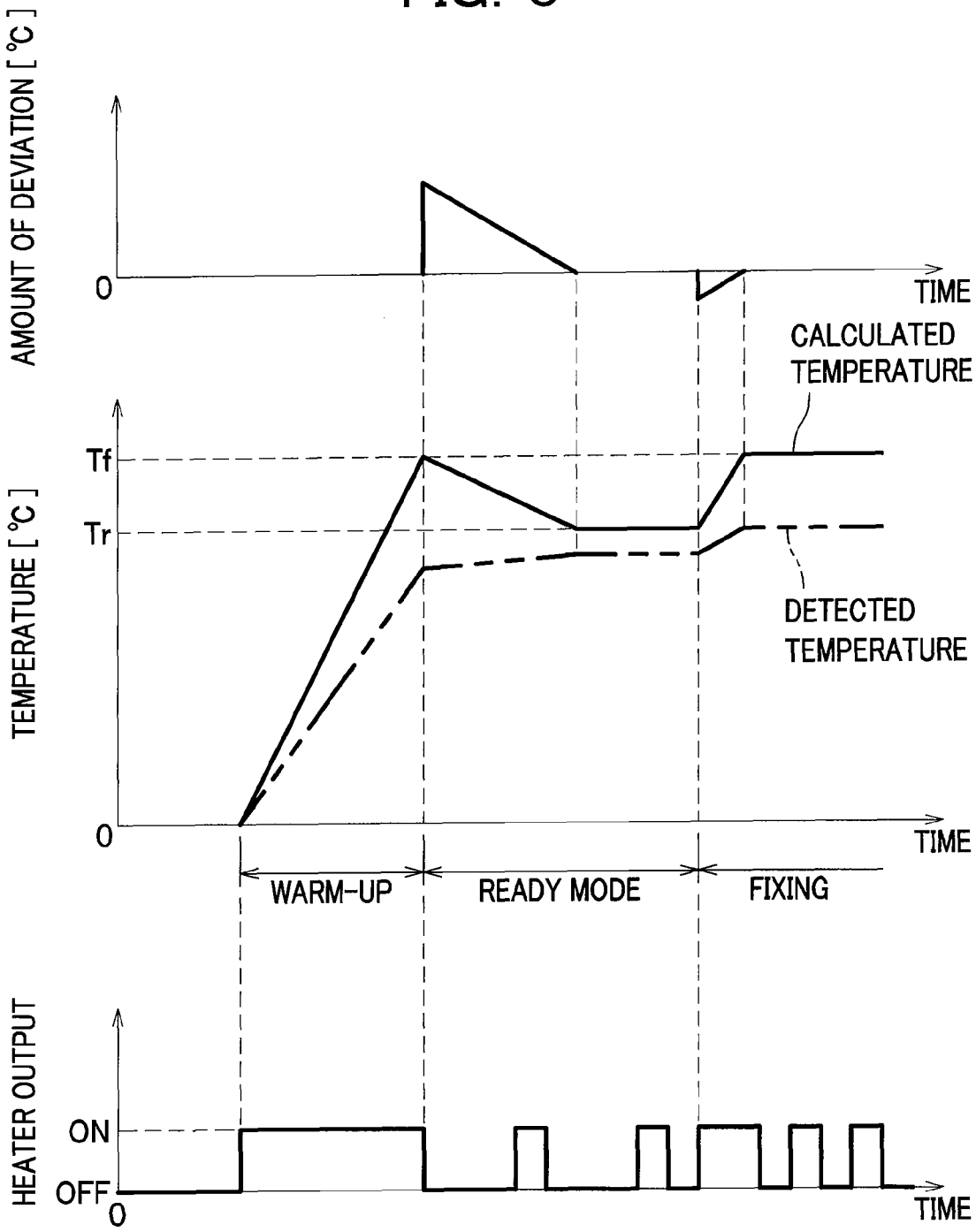
FIG. 6 is a time chart showing correlated changes in a heater output, detected and calculated temperatures, and an amount of deviation of the temperatures, as exhibited when the control mode is switched from the READY mode to the FIXING mode.

In the READY mode, the controller 100 causes the halogen heater HH to be activated (switched ON) intermittently with its ON states spaced at intervals longer than those in the FIXING modes so as to maintain the heating roller 41 at a predetermined ready temperature Tr which is lower than the fixing temperature Tf (see FIG. 6). In this way, the READY mode is designed to have heat produced with an instantaneous heat quantity greater than that of the heat to be produced in the FIXING mode (full speed) and smaller than that in the FIXING mode (half speed). Thus, in this READY mode, the controller 100 selects the function D "y=1.2x−16" having a slope smaller than that of the function B and greater than that of the function C, as shown in FIG. 2.

Figure 3:
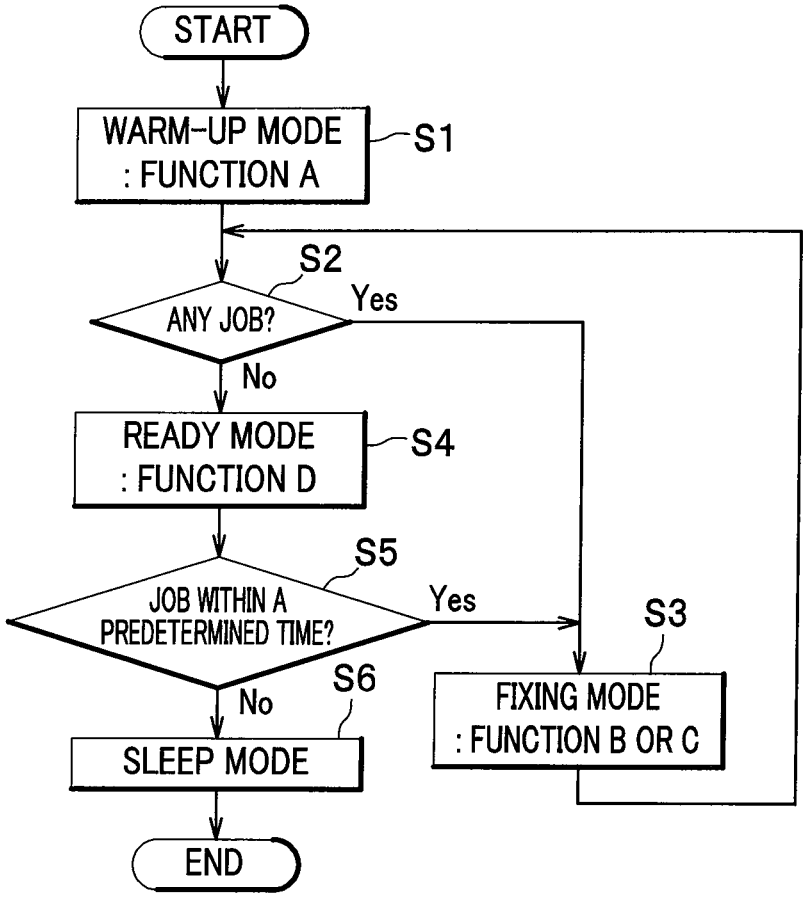
FIG. 3 is a flowchart showing an operation of a controller.

To be more specific, the controller 100 operates in accordance with the flowchart as shown in FIG. 3. As shown in FIG. 3, upon turning-on of the power of the laser printer 1 or receipt of a print job by the laser printer 1 in a sleep mode (start), the controller 100 executes a process for the WARM-UP mode (S1).

In step S1, the controller 100 selects the function A, and substitutes the detected temperature into the selected function A to determine the calculated temperature. Thereafter, the controller 100 continues the WARM-UP mode until the calculated temperature reaches the fixing temperature Tf (see FIG. 4).

When the calculated temperature is about to reach the fixing temperature Tf, the controller 100 determines whether or not any print job has been received before (S2). If the controller 100 determines in step S2 that one or more print jobs have ever been received before (Yes), then the controller 100 switches from the WARM-UP mode to the FIXING mode (S3).

When the control mode is switched in step S3 from the WARM-UP mode to the FIXING mode (provided that such mode switching takes place), the controller 100 switches from the function A to the function B or C having a slope smaller than that of the function A. During the operation in the FIXING mode, the controller 100 further execute a print control as known in the art (such as exposure of the photoconductor drum 27 to light, application of transfer bias to the transfer roller 30, and the others). After step S3, the controller 100 returns to the process in step S2.

If the controller 100 determines in step S2 that no print job has been received during the process in the WARM-UP mode or in the FIXING mode (No), then the controller 100 switches from the WARM-UP or FIXING mode to the READY mode (S4). When the control mode is switched in step S4 from the WARM-UP mode to the READY mode (provided that such mode switching takes place), the controller 100 switches from the function A to the function D having a slope smaller than that of the function A.

When the control mode is switched in step S4 from the FIXING mode to the READY mode (provided that such mode switching takes place), the controller 100 switches from the function B or C to the function D having a slope different from that of the function B or C. More specifically, the controller 100 selects the function D having a smaller slope if the immediately preceding function is the function B, and selects the function D having a greater slope if the immediately preceding function is the function C.

Subsequent to step S4, the controller 100 determines whether or not any print job has been received within a predetermined period of time (S5). If the controller 100 determines in step S5 that one or more print jobs have been received within the predetermined period of time (Yes), then the controller 100 switches from the READY mode to the FIXING mode (S3).

When the control mode is switched in step S3 from the READY mode to the FIXING mode (provided that such mode switching takes place), the controller 100 switches from the function D to the function B or C having a slope different from that of the function D. More specifically, the controller 100 selects the function C having a smaller slope, instead of the function D, if a print job received in step S5 and to be processed next indicates that the sheet on which a toner image is to be fixed is a thin sheet, and selects the function B having a greater slope, instead of the function D, if the print job received in step S5 and to be processed next indicates that the sheet on which a toner image is to be fixed is a thick sheet.

If the controller 100 determines in step S5 that no print job has been received within the predetermined period of time (No), then the controller 100 terminates the READY mode and shifts the process to the sleep mode, and thus makes an end of the control shown in FIG. 3. In the sleep mode, the halogen heater HH is turned OFF, and the rotation of the heating roller 41 is stopped.

When the function to be applied to the detected temperature is switched as described above, the calculated temperatures determined by two functions applied before and after the switching would differ greatly from each other. Therefore, when the function is switched, the controller 100 executes a control such that an amount of deviation corresponding to a difference between a pre-switching temperature determined immediately before the switching of the function and a post-switching temperature determined immediately after the switching of the function is added to the post-switching temperature, and gradually reduce the added amount of deviation to zero with time (see FIGS. 4-6).

Here, the "amount of deviation corresponding to a difference between . . . " may be a value of the difference itself, or may be a value smaller than the difference. In the present embodiment, a value that is 1 degree centigrade closer to zero than the difference is adopted as the amount of deviation. That is, if the difference shows a positive value, 1 degree centigrade is subtracted from the difference, and if the difference shows a negative value, 1 degree centigrade is added to the difference, so as to determine the amount of deviation. The amount of deviation may be calculated at the time of switching of the function; alternatively, the amount of deviation may be determined beforehand by experiments, simulations or the like and stored in a storage device.

To be more specific, when the control mode is switched from the WARM-UP mode to the FIXING mode, as shown in FIG. 4, assuming for example that the detected temperature at the time of switching is 145 degrees centigrade, the pre-switching temperature calculated using the function A "y=1.5x−9" is about 208 degrees centigrade. In like manner, the post-switching temperatures calculated using the functions B "y=1.3x−15" and the function C "y=1.1x+14", respectively, are both about 173 degrees centigrade. Accordingly, the difference between the pre-switching and post-switching temperatures is "35 degrees centigrade", and the amount of deviation corresponding to the difference is "34 degrees centigrade".

This amount of deviation is then added to the post-switching temperature: 173 degrees centigrade+34 degrees centigrade=207 degrees centigrade. As a result, an immoderately steep change of the calculated temperature to a negative side, which would otherwise be effected at the time when the control mode is switched from the WARM-UP mode to the FIXING mode, is prevented. Furthermore, thereafter, the amount of deviation "34 degrees centigrade" is decreased by 1 degree centigrade at a predetermined interval (e.g., each 100 msec), and the resultant value is added to a consecutively calculated temperature each time.

To be more specific, assuming for example that the detected temperature after 100 msec becomes 146 degrees centigrade, the calculated temperature after 100 msec is: about 174 degrees centigrade (that is the temperature calculated using the function B or the function C)+33 degrees centigrade (amount of deviation)=about 207 degrees centigrade. Assuming for example that the detected temperature after 200 msec becomes 147 degrees centigrade, the calculated temperature after 200 msec is: about 176 degrees centigrade+32 degrees centigrade=about 208 degrees centigrade.

As is evident from the above description, when the control mode is switched from the WARM-UP mode to the FIXING mode, the detected temperature rises gradually, and the amount of deviation, set at the time of switching of the mode is decreased gradually. Thus, the calculated temperature can be maintained around the fixing temperature Tf.

Figure 5:
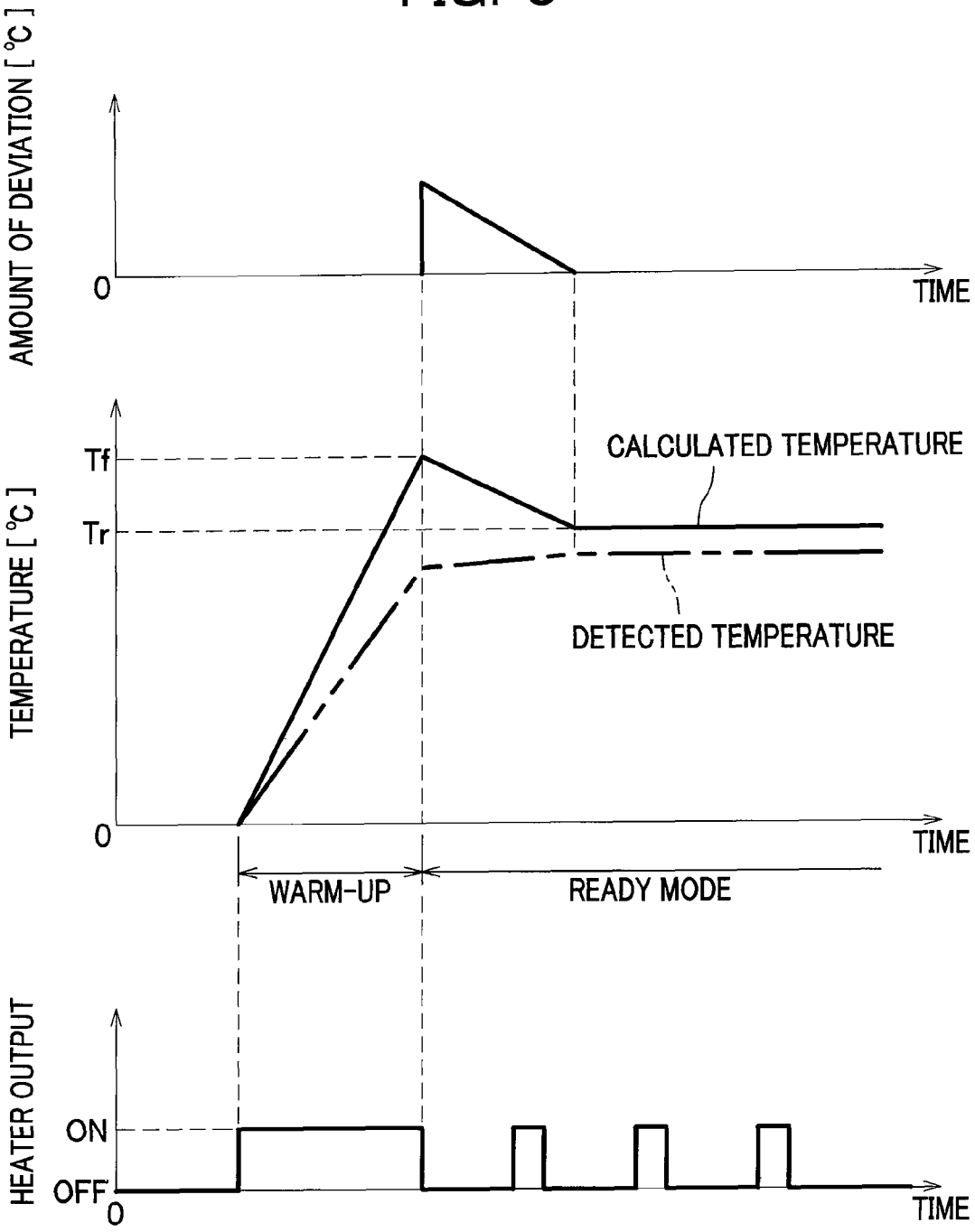
FIG. 5 is a time chart showing correlated changes in a heater output, detected and calculated temperatures, and an amount of deviation of the temperatures, as exhibited when the control mode is switched from the WARM-UP mode to a READY mode.

Similarly, when the control mode is switched from the WARM-UP mode to the READY mode, as shown in FIG. 5, assuming for example that the detected temperature at the time of switching is 145 degrees centigrade, the pre-switching temperature calculated using the function A "y=1.5x−9" is about 208 degrees centigrade. In like manner, the post-switching temperature calculated using the function D "y=1.2x−16" is about 158 degrees centigrade. Accordingly, the difference between the pre-switching and post-switching temperatures is "50 degrees centigrade", and the amount of deviation corresponding to the difference is "49 degrees centigrade".

This amount of deviation is then added to the post-switching temperature: 158 degrees centigrade+49 degrees centigrade=207 degrees centigrade. As a result, an immoderately steep change of the calculated temperature to a negative side, which would otherwise be effected at the time when the control mode is switched from the WARM-UP mode to the READY mode, is prevented. Furthermore, thereafter, the amount of deviation "49 degrees centigrade" is decreased by 1 degree centigrade at a predetermined interval (e.g., each 100 msec), and the resultant value is added to a consecutively calculated temperature each time.

To be more specific, assuming for example that the detected temperatures after 100 msec and 200 msec remain 145 degrees centigrade, the calculated temperature after 100 msec is: about 158 degrees centigrade+48 degrees centigrade=about 206 degrees centigrade; and the calculated temperature after 200 msec is: about 158 degrees centigrade+47 degrees centigrade=about 205 degrees centigrade. Assuming for example that the detected temperatures after 300 msec and 400 msec become 146 degrees centigrade, the calculated temperature after 300 msec is: about 159 degrees centigrade+46 degrees centigrade=about 205 degrees centigrade; and the calculated temperature after 400 msec is: about 159 degrees centigrade+45 degrees centigrade=about 204 degrees centigrade.

As is evident from the above description, when the control mode is switched from the WARM-UP mode to the READY mode, the detected temperature rises moderately, and the amount of deviation set at the time of switching of the mode is decreased gradually at a rate higher than the rise of the detected temperature. Thus, the calculated temperature can be changed gradually from the fixing temperature Tf to the ready temperature Tr.

When the control mode is switched from the READY mode to the FIXING mode, as shown in FIG. 6, assuming for example that the detected temperature at the time of switching is 145 degrees centigrade, the pre-switching temperature calculated using the function D "y=1.2x−16" is about 158 degrees centigrade. In like manner, the post-switching temperatures calculated using the function B "y=1.3x−15" and the function C "y=1.1x+14", respectively, are both about 173 degrees centigrade. Accordingly, the difference between the pre-switching and post-switching temperatures is "−15 degrees centigrade", and the amount of deviation corresponding to the difference is "−14 degrees centigrade".

This amount of deviation is then added to the post-switching temperature: 173 degrees centigrade−14 degrees centigrade=159 degrees centigrade. As a result, an immoderately steep change of the calculated temperature to a positive side, which would otherwise be effected at the time when the control mode is switched from the READY mode to the FIXING mode, is prevented. Furthermore, thereafter, the amount of deviation "−14 degrees centigrade" is increased closer to zero by 1 degree centigrade at a predetermined interval (e.g., each 100 msec), and the resultant value is added to a consecutively calculated temperature each time.

To be more specific, assuming for example that the detected temperature after 100 msec becomes 146 degrees centigrade, the calculated temperature after 100 msec is: about 174 degrees centigrade−13 degrees centigrade=about 161 degrees centigrade. Assuming for example that the detected temperature after 200 msec becomes 147 degrees centigrade, the calculated temperature after 200 msec is: about 176 degrees centigrade−12 degrees centigrade=about 164 degrees centigrade.

As is evident from the above description, when the control mode is switched from the READY mode to the FIXING mode, the detected temperature rises gradually, and the amount of deviation is increased gradually (toward zero). Thus, the calculated temperature can be changed gradually from the ready temperature Tr to the fixing temperature Tf.

According to the present embodiment as described above, the following advantageous effects may be expected.

Since the function to be applied is switched among a plurality of functions A-D according to a control mode which is switchable among a plurality of modes and in which operation of the halogen heater HH is regulated, even if the instantaneous heat quantity varies depending upon the control mode (which mode is currently selected), the temperature detected by the thermistor TH can be corrected appropriately, so that a high-precision temperature control can be executed.

Since a function with a greater slope is selected as the function to be applied in determination of the temperature when the control mode is switched to a mode in which the instantaneous heat quantity is greater, even if the capability of detection of the thermistor TH can not follow the sudden increase in the instantaneous heat quantity, the temperature can be corrected appropriately, so that the temperature of the heating roller 41 can be determined accurately.

Since the function can be switched according to the rotation speed of the heating roller 41 in the FIXING mode, even if the instantaneous heat quantity is changed as a result of the change in the rotation speed of the heating roller 41, the detected temperature can be corrected using an appropriate function corresponding to the changed instantaneous heat quantity, so that the temperature of the heating roller 41 in the FIXING mode can be determined accurately.

Since, after switching the function, the amount of deviation corresponding to the difference between the pre-switching temperature and the post-switching temperature is added to the post-switching temperature, and the amount of deviation is gradually reduced to zero with time, an immoderately steep change of the calculated temperature upon switching of the mode can be prevented, so that the control can be executed in an appropriate manner.

The present invention is not limited to the above-described embodiment, and various modifications and changes may be made to the specific configurations as described above without departing from the scope of the present invention where appropriate.

In the above-described embodiment, the heating roller 41 is regulated in the FIXING mode such that the rotation speed thereof is switched between the full speed and the half speed, but the present invention is not limited to this specific configuration. For example, the rotation speed of the heating roller 41 may be controlled to be switchable among three speeds.

In the above-described embodiment, the halogen heater HH is adopted as one example of the heat source, but the present invention is not limited thereto; for example, an induction heating (IH) type heater, a heat-generating resistor or the like may be used, instead.

In the above-described embodiment, the heating roller 41 is adopted as one example of the heating member, but the present invention is not limited thereto; for example, a cylindrical fixing film slidably supported by a guide may be used, instead.

Furthermore, the "temperature" is described by a temperature as measured in degrees centigrade, but any possible embodiments of the present invention may adopt any other values such as the resistance, voltage or the like of the resistor for detection of temperature in the thermistor TH. The temperature in degrees centigrade may be preprocessed where appropriate before being applied to the control in accordance with the present embodiment.

In the above-described embodiment, the laser printer 1 is shown as one example of an image forming apparatus, but the image forming apparatus to which the present invention is applicable is not limited thereto. For example, the image forming apparatus consistent with the present invention may include a photocopier and a multi-function peripheral. In the above-described embodiment, the sheet 3 is described on the premise that the sheet 3 is a sheet of paper such as a cardboard, postcard, tracing paper, etc., but a sheet or a recording sheet consistent with the present invention is not limited thereto. For example, an OHP sheet may be used, instead.

What is claimed is:

1. An image forming apparatus comprising:

a heat source;

a heating member configured to be heated by the heat source to fix a developer image on a recording sheet, wherein the heating member is configured to rotate;

a temperature sensor disposed apart from the heating member to detect a temperature of the heating member; and a controller including a memory which stores a first linear function having a first slope, a second linear function having a second slope smaller than the first slope of the first linear function, a third function having a third slope smaller than the second slope of the second linear function, and a fourth linear function having a fourth slope smaller than the third slope of the third linear function, wherein the controller is configured to:

control the heat source based upon a temperature determined mathematically by application of the first linear function to the temperature detected by the temperature sensor during a warm-up mode in which continuous increase in temperature of the heating member takes place;

control the heat source based upon a temperature determined mathematically by application of the second linear function to the temperature detected by the temperature sensor during a first fixing mode in which the heating member is maintained at a predetermined fixing temperature and in which the heating member rotates at a first rotational speed;

control the heat source based upon a temperature determined mathematically by application of the third linear function to the temperature detected by the temperature sensor during a ready mode in which the heating member is maintained at a ready temperature that is lower than the fixing temperature; and control the heat source based upon a temperature determined mathematically by application of the fourth linear function to the temperature detected by the temperature sensor during a second fixing mode in which the heating member is maintained at a predetermined fixing temperature and in which the heating member rotates at a second rotational speed, wherein the second rotational speed is faster than the first rotational speed.

2. The image forming apparatus according to claim 1, wherein the controller switches a linear function to be applied to a temperature detected by the temperature sensor into another linear function with a greater slope when a control mode is switched to a mode in which a quantity of heat emitted from the heat source per unit time is greater.

3. The image forming apparatus according to claim 1, wherein the fixing temperature is a temperature suitable to fix the developer image on the recording sheet.

4. The image forming apparatus according to claim 1, wherein the controller is configured to:

maintain the heat source in an ON state continuously to swiftly heat up the heating member in the warm-up mode;

turn the heat source into the ON state intermittently to maintain the heating member at the fixing temperature in the first and second fixing modes; and turn the heat source into the ON state intermittently with the ON state spaced at intervals longer than those in the first and second fixing modes to maintain the heating member at the ready temperature in the ready mode.

5. The image forming apparatus according to claim 1, wherein the controller is configured to calculate an amount of deviation between first and second temperatures determined by linear functions applied before and after switching between the linear functions, respectively, and to add the calculated amount of the deviation to the second temperature and gradually reduce the added amount of the deviation to zero with time, to obtain a corrected temperature based upon which the operation of the heat source is regulated.

* * * * *